US005735714A

United States Patent [19]

Orlando et al.

[11] Patent Number: 5,735,714

[45] Date of Patent: Apr. 7, 1998

[54] INFORMATION MANAGEMENT OUTLET MODULE AND ASSEMBLY PROVIDING PROTECTION TO EXPOSED CABLING

[75] Inventors: Stephen A. Orlando, Longboat Key, Fla.; Walter R. Schwer, Westerly, R.I.

[73] Assignee: Ortronics Inc., Pawcatuck, Conn.

[21] Appl. No.: 417,596

[22] Filed: Apr. 6, 1995

[51] Int. Cl.[6] ..... H01R 23/02

[52] U.S. Cl. ..... 439/676; 439/535; 439/954

[58] Field of Search ..... 439/676, 344, 439/675, 535

[56] References Cited

U.S. PATENT DOCUMENTS

| | | | |
|---|---|---|---|
| 1,481,771 | 11/1924 | Workman . | |
| 2,427,349 | 9/1947 | Boynton | 173/330 |
| 3,611,264 | 10/1971 | Ellis, Jr. | 339/99 R |
| 3,611,624 | 10/1971 | Nieman | 46/114 |
| 3,798,587 | 3/1974 | Ellis, Jr. et al. | 339/97 P |
| 3,978,587 | 9/1976 | Baugh | 33/80 |
| 4,118,095 | 10/1978 | Berglund et al. | 339/99 |
| 4,558,172 | 12/1985 | Zetena | 174/66 |
| 4,865,564 | 9/1989 | Denkmann et al. | 439/404 |
| 4,874,904 | 10/1989 | DeSanti | 174/53 |
| 4,950,840 | 8/1990 | Zetena | 174/66 |
| 5,124,506 | 6/1992 | Briggs et al. | 174/67 |
| 5,127,082 | 6/1992 | Below et al. | 385/135 |
| 5,178,554 | 1/1993 | Siemon et al. | 439/676 |
| 5,295,869 | 3/1994 | Siemon et al. | 439/620 |
| 5,362,254 | 11/1994 | Siemon et al. | 439/536 |

FOREIGN PATENT DOCUMENTS 0585731 8/1993 European Pat. Off. .

OTHER PUBLICATIONS

WAE–Anschlussdosen, ungeschirmt Brochure, Albert Ackermann GmbH & Co. KG, Gummersbach, Germany, Mar. 1993.

RJ45 Schragauslass Brochure, Molex.

WAEG–Anschlussdosen, Kategorie 5 Brochure, Ackermann Informationstechnik.

*Primary Examiner*—Neil Abrams
*Assistant Examiner*—Eugene G. Byrd
*Attorney, Agent, or Firm*—St. Onge Steward Johnston & Reens LLC

[57] ABSTRACT

An RJ-type connector outlet module which provides protected access to the front of a module and permits straight-on solderless connections to the back. The module has a frame with a channel for receiving an RJ-type connector plug wherein the channel is recessed and obliquely oriented with respect to the front face of the frame. A connector jack within the channel is configured to attach to a planar printed circuit board attached to the rear surface of the frame such that an IDC terminal strip can be mounted to permit straight-on insertion of wires.

6 Claims, 2 Drawing Sheets

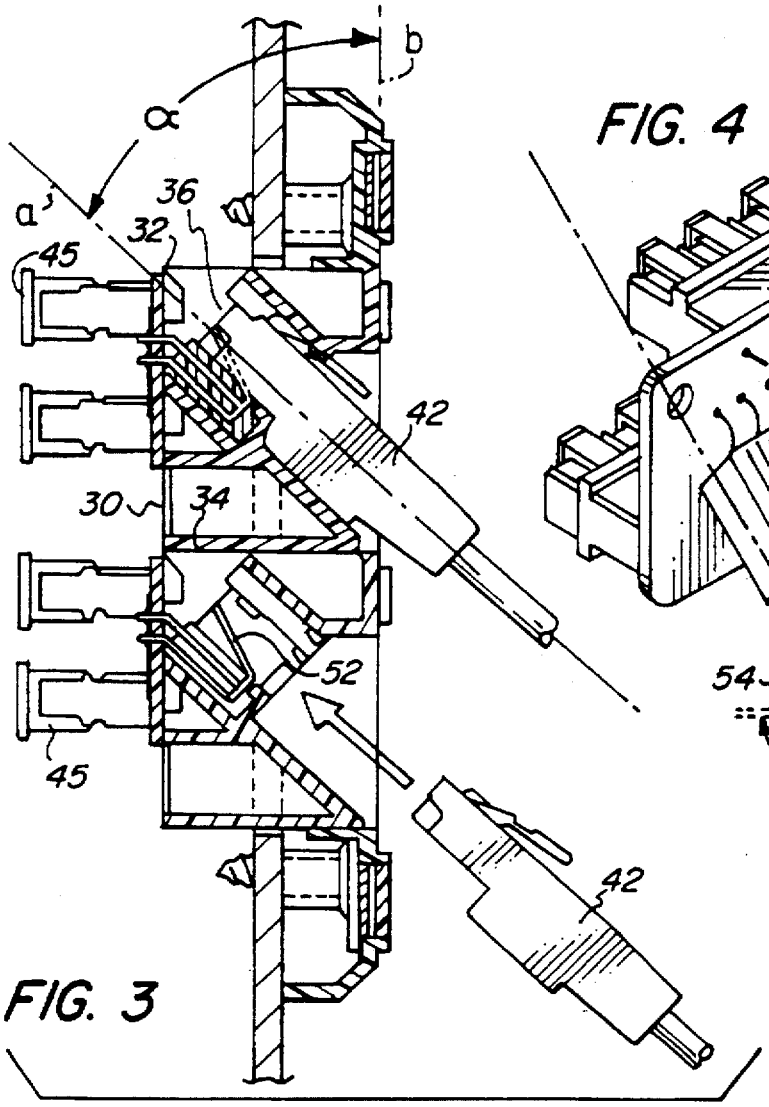
FIG. 3
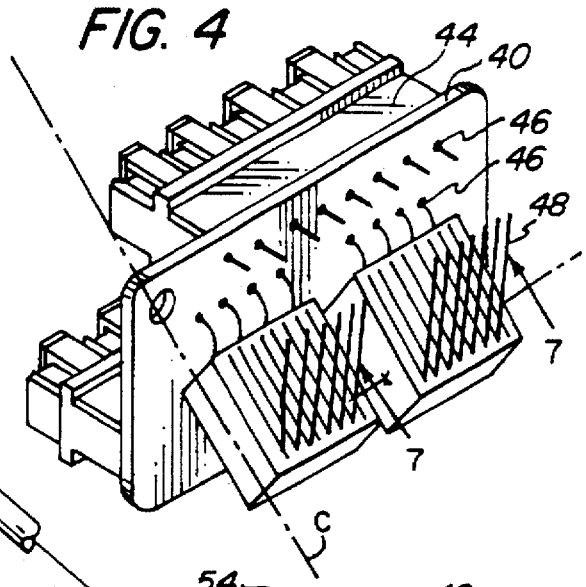
FIG. 4
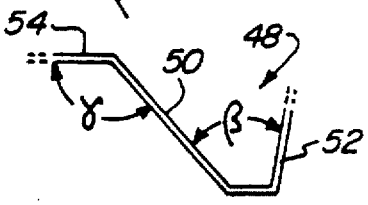
FIG. 6
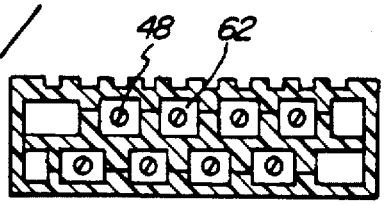
FIG. 7
FIG. 5
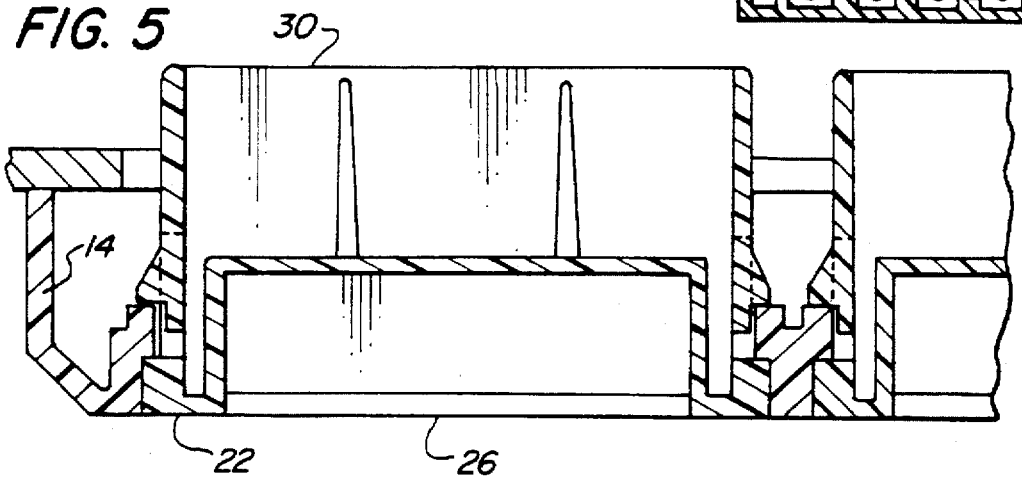

INFORMATION MANAGEMENT OUTLET MODULE AND ASSEMBLY PROVIDING PROTECTION TO EXPOSED CABLING

TECHNICAL FIELD

The invention relates to improvements in information management outlet modules and assemblies including them. In particular, the invention provides outlet modules of the RJ-type which protect communications cables connected thereto. It is a particular advantage of the invention that cable connections to RJ-type connectors are protected at the front of a faceplate yet permit straight-on connections to IDC (Integrated Displacement Connector) PCB (Printed Circuit Board) terminations at the back side of the faceplate.

Communications technology (including data, video and voice processing and transmission) is placing ever-increasing demands on wire management systems and the personnel responsible for their installation and maintenance. The design of all system components must be done with attention to system integrity and ease of performance of associated manual tasks. Current technology does not provide the degree of protection to exposed cabling coupled with ease of assembly that might be desired.

Efficient wire management requires convenient access to equipment and rapid, accurate connection and disconnection—often of several individual services (e.g., electronic data processing, telecommunications, and video) and several different kinds of cabling. The connection of copper wire to RJ-type connectors, typically involves attaching patch or other cables to the exposed front of a faceplate and terminating the connectors to copper wires connected to the rear of the connector by means of IDC PCB mounted connectors. Effective wire management should provide protection of the cabling at the front and ease of assembly from the rear.

One drawback of RJ 45 and other connectors in use today is that they expose a significant amount of cable as it projects from the front of a connector mounted in a faceplate. The problem exists even with regard to some of the newer connectors which enable the cabling to extend downwardly from the front of the RJ-type connector. In some cases, the provision of a downwardly extending cable has eliminated the possibility of straight-on connection to the IDC PCB connectors at the rear of the RJ-type connector. Another disadvantage is that they leave the cable exposed to collision and breakage. It is also necessary to assure that small children cannot put their fingers inside the connectors and become ensnared on the spring wire contacts therein.

There is a need for a connector which provides protection at the front panel and ease of assembly at the rear.

BACKGROUND ART

The art has provided a number of different of RJ-type connectors. Among these are U.S. Pat. No. 5,362,254 to Siemon and Below which describes a modular connector having an outwardly projecting faceplate having an opening on its angled underside to permit the cable to hang downwardly. The advantage of this arrangement, as opposed to those wherein the cable projects straight outwardly from the wall, is said to be increasing the bend radius. This inhibits bends so extreme that the minimum bend radius necessary for Category 5 (ANSI/EIA/TIA-568 and TIA/EIA TSB40) outlets is exceeded. The disadvantage of this arrangement, like those of Boynton in U.S. Pat. No. 2,427,349, Workman in U.S. Pat. No. 1,481,771, and Briggs, et at. In U.S. Pat. No. 5,124,506, for example, is that the projection of the front face plate leaves the connector exposed to damage by moving objects and actually creates an additional obstruction. Another disadvantage with the arrangement is that the rear connectors are positioned at an angle which prevents straight-on attachment of wires—this presents a configuration which is unusual to the technician and can be a source of frustration and error.

In the field of fiber optics, the provision of outwardly and downwardly projecting connectors is shown in U.S. Pat. No. 4,669,802 to Schaffer. This field has also provided connectors which extend downwardly from recessed faceplates. For example, U.S. Pat. No. 4,874,904 to DeSanti shows two fiber optic connectors attached to a recessed panel in the faceplate of an outlet box. In U.S. Pat. No. 5,127,082, Below, et al. show a box having a series of inserts on a bottom panel to permit the cables to extend downwardly with no major bend. These arrangements are effective for their purposes, but do not address the need for a protected RJ-type connector which permits the straight-on connection of wires to the rear. Indeed, of these, DeSanti is the only one which shows an RJ-type connector, and it is shown with the opening at right angles with the faceplate and extending outwardly therefrom.

Similarly, recessed connectors have been proposed for coaxial cables. Of these, in U.S. Pat. No. 4,950,840, Zetena shows, not a modular connector for snapping in and out of a multipurpose faceplate, but a one-piece faceplate with a recessed panel for connecting coaxial cables and permit them to extend downwardly close to the wall on which the faceplate is directly mounted. This does not, however, address either a modular connector or the need for a protected RJ-type connector permitting straight-on connection of copper wires to an IDC PCB at the rear.

Despite the variety of designs for various connectors, no modular RJ-type connector is known to assure protection of the RJ-type connector cable from collision and breakage at the front and provide ease of connection to printed circuit board mounted insulation displacement connectors at the rear. There is a need for such a connector to assure efficient and reliable wire management.

DISCLOSURE OF THE INVENTION

It is an object of the invention to provide an improved RJ-type connector which provides protected access to the front of a module and permits straight-on solderless connections to the back.

It is another object of the invention to provide a feature which protects an RJ-type connector cable from collision with furniture or other objects until a sufficient length of flexible cabling extends from the RJ-type or other connector to decrease stress to the connector itself.

It is another and still more specific object of the invention to provide an outlet module of the RJ-type connector-type which can be inserted into a multipurpose faceplate to assure protection of the RJ-type connector cable from collision and breakage at the front and provide ease of connection to printed circuit board mounted insulation displacement connectors at the rear.

These and other objects are achieved by the present invention which provides an improved RJ-type connector outlet module which provides protected access to the front of a module and permits straight-on solderless connections to the back, comprising:

a frame having a planar front surface having a top edge and a bottom edge and an opening therein extending from the bottom edge, said opening being of a size effective to accommodate an RJ-type connector plug;

a rear surface parallel to the front surface and having a top edge and a bottom edge;

a channel having a long axis which extends obliquely parallel to a line extending from bottom edge of the front surface toward the top edge of the rear surface, preferably at an angle of from 30° to 60° with respect to a vertical line on the planar front surface of the frame;

a planar printed circuit board attached to the rear surface of the frame and including through holes and conductive traces in a predetermined arrangement;

a plurality of jack wires bent to include a straight central segment, a straight spring forming an acute angle with the central segment, and a straight segment forming an obtuse angle with the central segment and extending though and soldered to predetermined through holes in said printed circuit board;

a jack wire frame having a long axis aligned with the channel and including a plurality of parallel grooves parallel to said long axis for holding the jack wires parallel to one another and aligned with the channel;

a terminal strip including a plurality of connector means for attaching wires along an axis of insertion perpendicular to the planar front face of the frame, and a plurality of conductive elements, each providing electrical continuity with a designated one of the connector means, and with each conductive element extending though and soldered to a predetermined through hole in said printed circuit board.

It is a feature and advantage of the invention that the new modular connector outlet can be snapped into place in a faceplate of the type employed to cover an outlet box or simply attached by means of screws to a wall surface. It is also a significant advantage that the modular connector outlet can be used with such a faceplate in combination with connectors of other types (e.g., for fiber optic or audio cables) or even with blank flat covers where fewer than the maximum number of connectors are required.

BRIEF DESCRIPTION OF THE DRAWINGS

The invention will be better understood and its advantages will be better appreciated from the following detailed description, especially when read in light of the accompanying drawings, wherein:

FIG. 3 is a cross sectional view, partially exploded, taken along line 3—3 in FIG. 2;

FIG. 4 is a perspective view showing the detail of the preferred arrangement of jack wires, a jack wire frame, and terminal strips on a printed circuit board;

FIG. 5 is a cross-sectional view taken along line 5—5 in FIG. 2;

FIG. 6 is a side elevational view of one of the jack wires; and

FIG. 7 is a cross-sectional view of a jack wire frame, the cross section taken along line 7—7 in FIG. 4.

INDUSTRIAL APPLICABILITY

The improvements of the invention have application to the field of connections employing modular connector outlets of the RJ-type. The term "RJ-type connector" is defined herein to include, specifically, the various modular communication connectors assigned RJ numbers according to the USOC. The drawings are intended to depict plugs and outlets of the RJ-45 type, but the invention is not limited to such. The description will refer to various parts by their usual orientation (e.g., front, back, top and bottom), however, this is done for ease of description and is not meant to limit the orientation of the devices in actual use.

Figure 1:
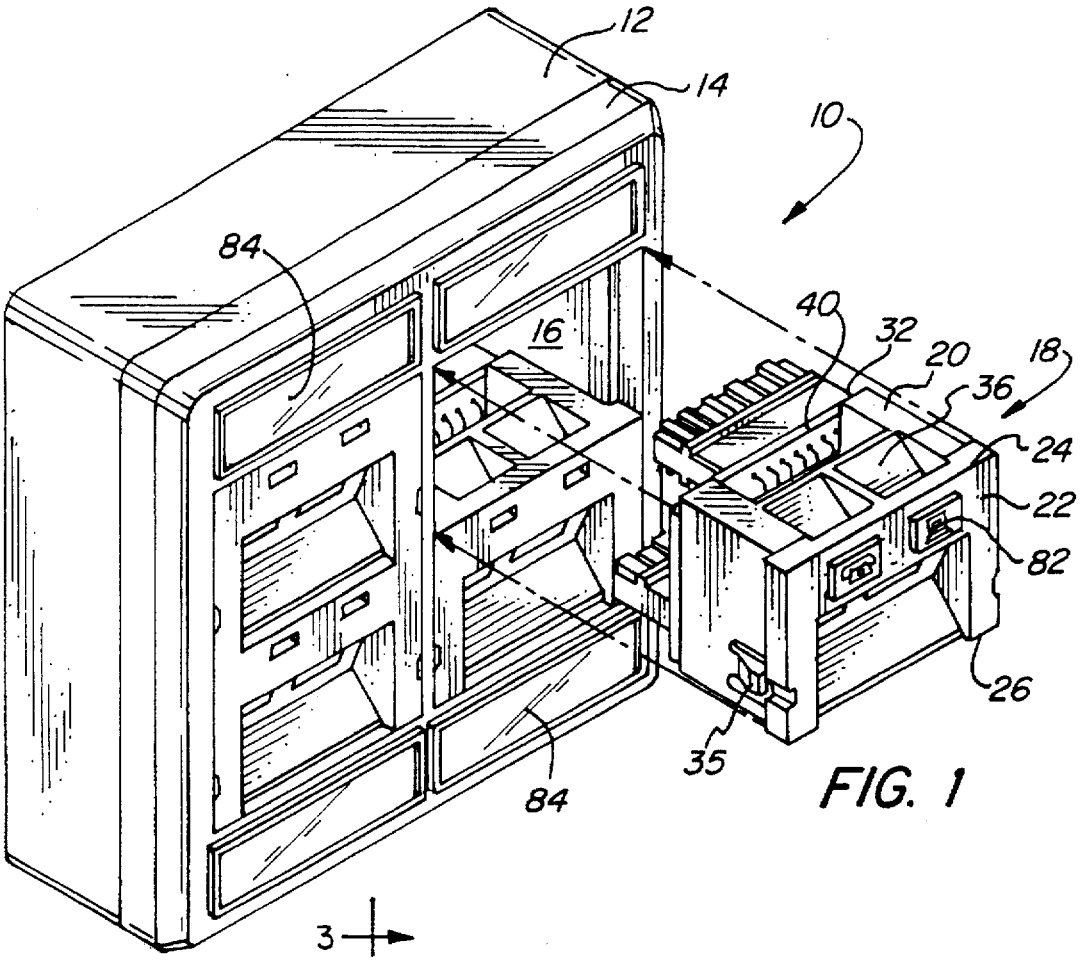
FIG. 1 is a perspective view, partially exploded, of a double gang outlet box covered with a faceplate holding four removable connector outlet modules, each containing two RJ-type connector outlets.
Figure 2:
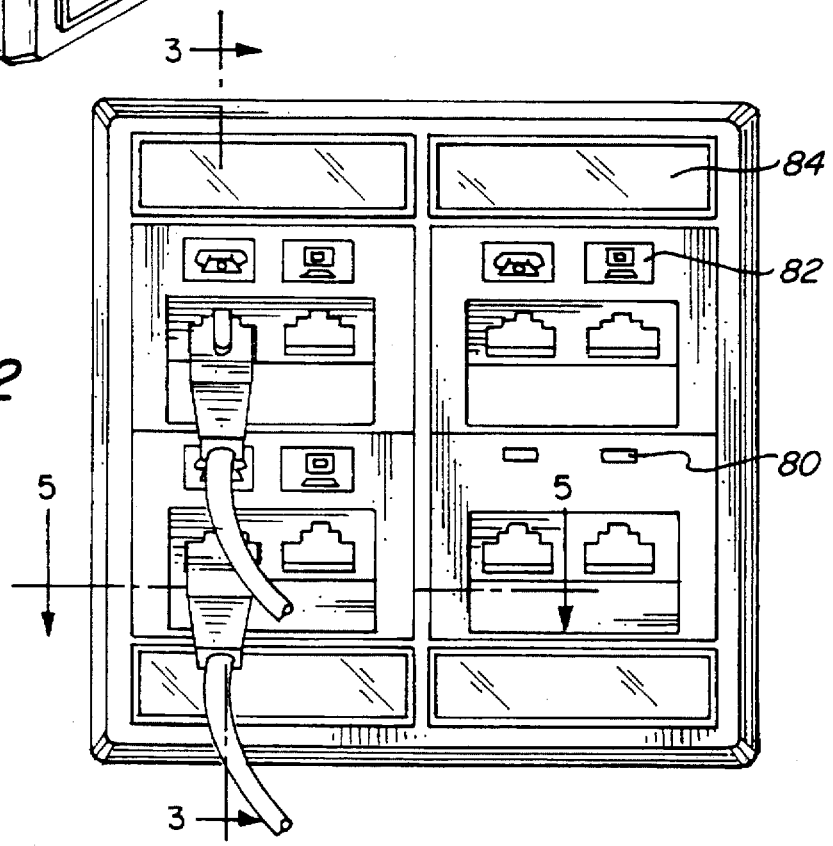
FIG. 2 is a front elevation of a double gang outlet of the type shown in FIG. 1, showing cables connected thereto.

FIG. 1 shows an information management outlet assembly, generally as 10, which includes a double gang outlet box 12. Over the outlet box is a faceplate 14 having openings 16 therein. All but one of the openings is shown to be occupied with a connector module 18 according to the invention. Each of these improved RJ-type connector modules 18 provides protected access to the front of the module but yet permits straight-on solderless connections to the back.

It is a feature and advantage of the invention that the new connector outlet module can be snapped into place in a faceplate of the type shown which is employed to cover an outlet box or simply attached by means of screws to a wall surface. It is also a significant advantage that the modular connector outlet can be used with such a faceplate in combination with connectors of other types (e.g., for fiber optic or audio cables) or even with blank flat covers where fewer than the maximum number of connectors are required.

Each of the RJ-type connector outlet modules 18 will include a frame 20 having a planar front surface 22 having a top edge 24 and a bottom edge 26. An opening 28 therein extending from the bottom edge 26. Opening 28 must be of a size effective to accommodate an RJ-type connector plug and preferably also additional room for fingers to permit manipulation of a plug. The frame will also include a rear surface 30 parallel to the front surface (see FIGS. 3 and 5, where this surface is shown defined by the rearward-most frame elements). The rear surface is shown to include a top edge 32 and a bottom edge 34. Resilient tabs 35 (see especially FIGS. 1 and 5) are shown molded integrally with the frame 20 to latch the frame, and thus the module, into the opening 16 in the faceplate 14.

A channel 36 for receiving an RJ-type connector plug extends obliquely to the front surface, its long axis (a in FIG. 3) is shown to extend parallel to a line which extends from bottom edge 26 of the front surface 22 toward the top edge 32 of the rear surface 30. The preferred oblique angle ($\alpha$in FIG. 3) is within the range of from 30° to 60° with respect to a vertical line (b in FIG. 3) on the planar front surface 22 of the frame 20.

Attached to the rear surface 30 of the frame 20 is a planar printed circuit board 40. The printed circuit board 40 provides the means for physical and electrical connection of outlet connector wires (which engage a plug, such as 42 in FIG. 3) to connector strips 44 (which provide solderless connection to insulated copper wires). The printed circuit board 40 includes through holes 46 and conductive traces (not shown) in a predetermined arrangement to effect the electrical connection as desired for the module. The printed circuit board is attached to the rear surface of the frame by any suitable means such as self-tapping screws, or the like.

FIG. 4 shows in detail the orientation of a plurality of jack wires 48 with respect to the printed circuit board 40 and the connector strips 44 which enables straight-on connection of wires to the connector strips. Each of the jack wires is bent substantially as shown in FIG. 6. The drawing shows the configuration of a representative jack wire as including a straight central segment 50, a straight spring segment 52 which forms an acute angle 13 with the central segment 50, and a straight segment 54 forming an obtuse angle γwith the central segment. The straight segment 54 is shown in FIGS. 3 and 4 to extend though and be soldered to a predetermined through hole 46 in the printed circuit board 40.

Also provided is a jack wire frame 60 which has a long axis (represented in FIG. 4 by line c) aligned with the channel. The jack wire frame is preferably molded (in one or more pieces) of a suitable plastic material to include a plurality of parallel internal guides 62 parallel to long axis c for holding the jack wires 48 parallel to one another and aligned with the channel 36. The guides can be grooves or bores or other forms of open or closed channels effective to hold the jack wires in the proper orientation.

Each of the jack wires 48 is connected to the printed circuit board 40 which in turn is connected to the appropriate pin of a terminal strip 44. Accordingly, the terminal strip 44 will include a plurality of connector means for attaching wires along an axis of insertion perpendicular to the planar front face of the frame. The connector means are shown in the drawing to be of the "110-type", as available from AT&T Technologies as the 110D series (see, for example U.S. Pat. Nos. 3,611,624, 3,978,587, and 4,118,095) or from other manufacturers. Also suitable are BIX connectors as made by Northern Telecom, and other insulation displacement connectors adapted for mounting on printed circuit boards.

Terminal strips 44 are shown to have a plurality of conductive elements 66 which displace the insulation from an inserted wire to provide electrical continuity between the wire and the connector. U.S. Pat. No. 4,865,564 to Denkman, et al. and U.S. Pat. No. 5,295,869 to Siemon, et al. are incorporated by reference to show the detail of construction of suitable connector strips. Each conductive element 66 and the like extends though and is soldered to a predetermined through hole in said printed circuit board. Insulated copper wires can thus be inserted by straight-on insertion along a line perpendicular to the front face of the module and the faceplate. Insertion of wires in this manner is most natural for the technician and causes the least stress on the printed circuit board and the junction of wires and other components thereto. Covers 45 can be provided to aid in making the wire insertion and to protect the connections once made.

To assure effective wire management, the modules will each have means to identify the type of line. The means typically include insertion holes 80 and tabs 82 having snap-fit bayonet ends on their rear side (not shown) to lock the tabs in place. Also, an identification strip such as designated as 84 is preferably employed for further identification and can include such information as the telephone number for a given line. Strips 84 are also useful to cover screw holes 86 in the faceplate.

The above description is for the purpose of teaching the person of ordinary skill in the art how to practice the invention, and it is not intended to detail all of those obvious modifications and variations of it which will become apparent to the skilled worker upon reading the description. It is intended, however, that all such obvious modifications and variations be included within the scope of the invention which is defined by the following claims. The claims are meant to cover the claimed elements and steps in any arrangement or sequence which is effective to meet the objectives there intended, unless the context specifically indicates the contrary.

We claim:

1. An RJ-type connector outlet module which provides protected access to the front of a module and permits straight-on solderless connections to the back, comprising:

a frame having a planar front surface with a channel extending therein for receiving an RJ-type connector plug, wherein the channel is recessed and obliquely oriented with respect to the front surface of the frame, wherein the channel has a long axis which forms an angle in the range from 30° to 60° with respect to a line that is vertical to the planar front surface of the frame and with the channel being sufficiently deep so that an inserted RJ-type connector plug makes electrical contact at a point that is rearwardly of the planar front surface; and a planar printed circuit board attached to the rear surface of the frame such that an IDC terminal strip can be mounted to permit straight-on insertion of wires.

2. A connector module according to claim 1 which further includes resilient tabs on opposed side faces of the frame to enable a snap fit with a suitable faceplate having an opening to receive said frame.

3. A connector module according to claim 1 which further includes a plurality of jack wires; and a jack wire frame having a long axis aligned with the channel and including a plurality of parallel guides parallel to said long axis for holding the jack wires parallel to one another and aligned with the channel and with the jack wire frame being rearwardly disposed with respect to the planar front surface of the frame.

4. A connector module according to claim 1 which further includes a plurality of jack wires bent to include a straight central segment, a straight spring forming an acute angle with the central segment, and a straight segment forming an obtuse angle with the central segment and extending though and soldered to predetermined through holes in said printed circuit board; and a jack wire frame having a long axis aligned with the long axis of the channel and with the jack wire frame being rearwardly disposed with respect to the planar front surface of the frame.

5. An information management outlet module assembly in accordance with claim 1 and further comprising:

a faceplate having an opening therein for receiving said RJ-type connector outlet module said face plate having a planar front surface and means for providing a snap fit of said RJ-connector module into said opening in said faceplate so as to place the planar front surface of the frame of said outlet module substantially flush with the planar front surface of said face plate.

6. An RJ-type connector outlet module which provides protected access to the front of a module and permits straight-on solderless connections to the back and a face plate, comprising:

a frame having a planar front surface having a top edge and a bottom edge and an opening therein extending from the bottom edge, said opening being of a size effective to accommodate an RJ-type connector plug;

a rear surface parallel to the front surface and having a top edge and a bottom edge;

a channel having a long axis which extends obliquely parallel to a line extending from bottom edge of the front surface toward the top edge of the rear surface; wherein the channel has a long axis which forms an angle in the range from 30° to 60° with respect to a line that is vertical to the planar front surface of the frame and with the channel being sufficiently deep so that an inserted RJ-type connector plug makes electrical contact at a point that is rearwardly of the planar front surface a planar printed circuit board attached to the rear surface of the frame and including through holes and conductive traces in a predetermined arrangement;

a plurality of jack wires bent to include a straight central segment, a straight spring forming an acute angle with the central segment, and a straight segment forming an obtuse angle with the central segment and extending though and soldered to predetermined through holes in said printed circuit board;

a jack wire frame having a long axis aligned with the channel and including a plurality of parallel guides parallel to said long axis for holding the jack wires parallel to one another and aligned with the channel; and with the jack wire frame being rearwardly disposed with respect to the planar front surface of the frame a terminal strip including a plurality of connector means for attaching wires along an axis of insertion perpendicular to the planar front face of the frame, and a plurality of conductive elements, each providing electrical continuity with a designated one of the connector means, and with each conductive element extending through and soldered to a predetermined through hole in said printed circuit board;

a faceplate having an opening therein for receiving said RJ-type connector outlet module;

said face plate having a planar front surface and means for providing a snap fit of said R J-connector module into said opening in said faceplate so as to place the planar front surface of the frame of said outlet module substantially flush with the planar front surface of said face plate.

* * * * *